US005591024A

United States Patent [19]

Eavenson et al.

[11] Patent Number: 5,591,024

[45] Date of Patent: Jan. 7, 1997

[54] ASSEMBLY FOR CONTROLLING THE FLOW OF GAS FOR GAS FIRED ARTIFICIAL LOGS

[75] Inventors: Barry Eavenson, Asheville; James S. Rice, Marshall, both of N.C.

[73] Assignee: Appalachian Stove & Fabricators, Inc., Ashville, N.C.

[21] Appl. No.: 327,394

[22] Filed: Oct. 21, 1994

Related U.S. Application Data

[63] Continuation-in-part of Ser. No. 104,668, Aug. 10, 1993, Pat. No. 5,397,233.

[51] Int. Cl.[6] ..... F23Q 13/00

[52] U.S. Cl. ..... 431/125; 431/76; 431/80

[58] Field of Search ..... 431/80, 76, 125, 431/126

[56] References Cited

U.S. PATENT DOCUMENTS

| | | | |
|---|---|---|---|
| 4,718,846 | 1/1980 | Oguri et al. | 431/79 |
| 4,778,378 | 10/1988 | Dolnick et al. | 431/80 X |
| 4,838,240 | 6/1989 | Rieger | 431/125 X |
| 5,051,089 | 9/1991 | Jayaram | 431/80 |
| 5,181,846 | 1/1993 | Chang | 431/80 |

OTHER PUBLICATIONS

Publication—Sourdillon—"Gas Domestic Appliance Controls" (No Date).

*Primary Examiner*—Larry Jones
*Attorney, Agent, or Firm*—Carter & Schnedler

[57] ABSTRACT

An apparatus is provided for controlling the flow of gas for artificial logs. The apparatus includes a main gas burner and a pilot as well as a gas valve which controls the flow of gas to the main burner and to the pilot. The pilot includes a oxygen depletion sensor. A thermal responsive electrical generator is adjacent to the pilot and is connected to the valve. The output voltage of the generator, while under load, is at least 140 millivolts so as to operate the gas valve, which is capable of full automatic operation without the use of an additional electrical source. In addition, the thermal responsive electrical generator is positioned with respect to the pilot so that gas from the pilot will not continue to burn about the generator when the oxygen depletion sensor senses a predetermined low level of oxygen.

19 Claims, 4 Drawing Sheets

ASSEMBLY FOR CONTROLLING THE FLOW OF GAS FOR GAS FIRED ARTIFICIAL LOGS

RELATED APPLICATION

This is continuation-in-part of U.S. patent application Ser. No. 08/104,668, filed Aug. 10, 1993, by Barry Eavenson and James S. Rice, titled "AN ASSEMBLY FOR CONTROLLING THE FLOW OF GAS FOR GAS FIRED ARTIFICIAL LOGS" and assigned to Appalachian Stove & Fabricators, Inc., assignee of the present application.

BACKGROUND OF THE INVENTION

This invention relates to gas fired artificial log assemblies. More particularly, it relates to gas fired artificial log assemblies which are used in unvented environments.

Woodburning fireplaces have been used for many years by homeowners to provide heat, as well as to provide an aesthetically pleasing home environment. All woodburning fireplaces, however, require venting of the products of combustion through a chimney, otherwise deadly fumes, such as carbon monoxide, will build up in the house and can cause illness, and even death. Obviously, a chimney requires a substantial capital expenditure.

In addition, use of woodburning fireplaces require the user to haul wood into the house, light the fire, and maintain the fire. In addition, woodburning fireplaces require the user to maintain an adequate source of wood which must be kept dry in order to be useful.

More recently, homeowners have turned to artificial logs which are fired with either natural gas or propane as a substitute for woodburning fireplaces. Gas fired artificial log systems are clean and efficient, easy to use, and require almost no maintenance. In addition, newer artificial log systems provide for a yellow flame flicker which provides a substantial duplication of the warm appearance of a natural wood fire. Artificial logs made of ceramics will actually glow giving the appearance of glowing embers. However, heretofore, most artificial log systems continue to be vented through a chimney arrangement in a very similar fashion to a woodburning fireplace. In fact, many artificial log systems are simply retrofits of a woodburning fireplace.

More recently it has been found that because natural gas and propane are very clean burning materials, gas fired artificial logs may be used in an unvented environment. However, because any combustion in a room utilizes oxygen as a component necessary in the combustion, as a safety factor oxygen depletion sensors are required which will automatically shut off the gas valve and thus the gas to the log should oxygen reach a certain low level in the room.

The only control system known to applicant which is used in an unvented situation are the systems like the one manufactured by Sourdillon of Vigne, France. Those systems utilize a pilot which is integrated with a oxygen depletion sensor. The pilot is fed by a manually operated gas valve which also feeds a main burner. A low voltage (32 millivolts) thermocouple is positioned a predetermined distance and slightly below the pilot. The thermocouple is tied to the valve so that if the pilot is extinguished due to low oxygen, the valve will shut off the gas to the pilot as well as to the main burner.

This type of thermocouple control system is capable of producing only 32 millivolts and thus may not be used to control a fully automatic gas valve such as one made by ITT's General Controls Division (Catalog No. B67RA01). The ITT valve is capable of fully automated operation, i.e., it may be used in conjunction with a thermostat to sense the room temperature and turn the main valve off and on and also may be used with infrared remote controls.

Thus, there is a need for a fully automatic gas log system which may be used in unvented environments.

OBJECTS OF THE INVENTION

It is therefore one object of this invention to provide an assembly for controlling gas logs in an unvented as well as a vented environment without the use of an external electrical source.

It is another object to provide a gas log control apparatus which includes a oxygen depletion sensor used in conjunction with a gas valve which is capable of fully automatic control.

It is still another object to provide an assembly for controlling the flow of gas to artificial logs which is easy to use and inexpensive to produce.

SUMMARY OF THE INVENTION

In accordance with one form of this invention, there is provided an assembly for controlling the flow of gas for artificial logs. The assembly includes a main burner and a pilot, as well as a gas valve for controlling the flow to the main burner and to the pilot. The pilot, which is connected to the gas valve, has an opening where flame is produced. The pilot includes a oxygen depletion sensor for extinguishing the pilot flame, but not the flow of gas, when the surrounding oxygen reaches a predetermined low level. A thermal responsive electrical generator or thermopile is connected to the gas valve. It is preferred that the thermal responsive electrical generator will generate at least 140 millivolts of voltage, while under load, so that a fully automated gas valve may be used.

The gas generator includes an outer barrel. The outer barrel is juxtaposed to the pilot opening. It is preferred that the distance from the point on the barrel nearest the pilot opening is between 0.5 inches and 1.5 inches from the pilot opening so that the thermal responsive electrical generator will generate sufficient voltage to operate the valve when the flame is emanating from the opening and so that the gas coming from the opening after the flame has been extinguished by the oxygen depletion sensor will not be ignited about the barrel which would cause the valve to not properly shut off in low oxygen situations.

In addition, it is preferred that the top of the barrel be elevated above the pilot opening. It is also preferred that a thermostat be electrically connected to the gas valve so that the gas valve and thus the gas logs will automatically operate for predetermined temperature levels within the room where the logs are located.

BRIEF DESCRIPTION OF THE DRAWINGS

The subject matter which is regarded as the invention is set forth in the appended claims. The invention itself, however, together with further objects and advantages thereof may be better understood in reference to the following description taken in conjunction with the accompanying drawings in which:

DESCRIPTION OF THE PREFERRED EMBODIMENTS

Figure 1:
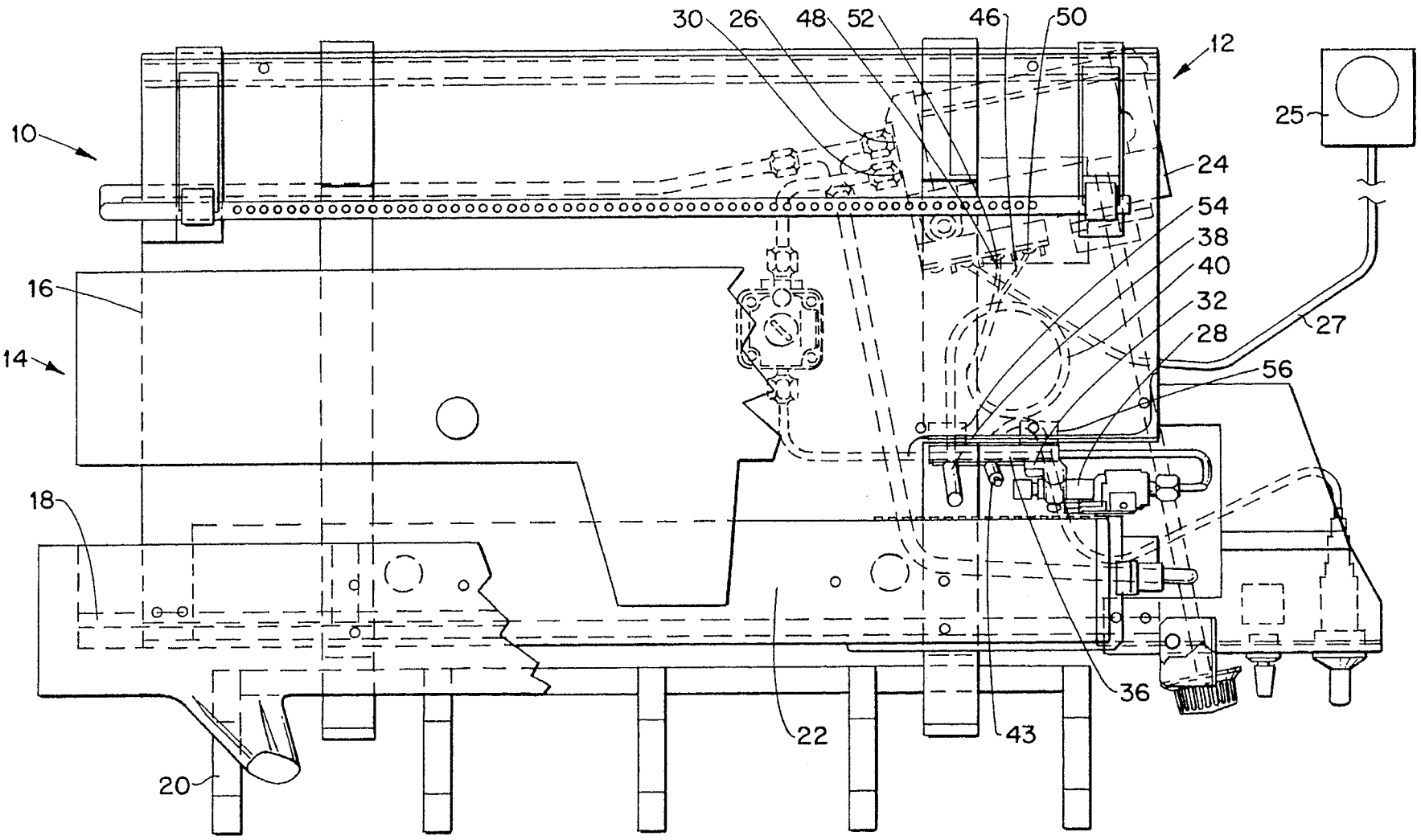
FIG. 1 is a top view of the apparatus of the subject invention connected to an artificial log assembly.
Figure 2:
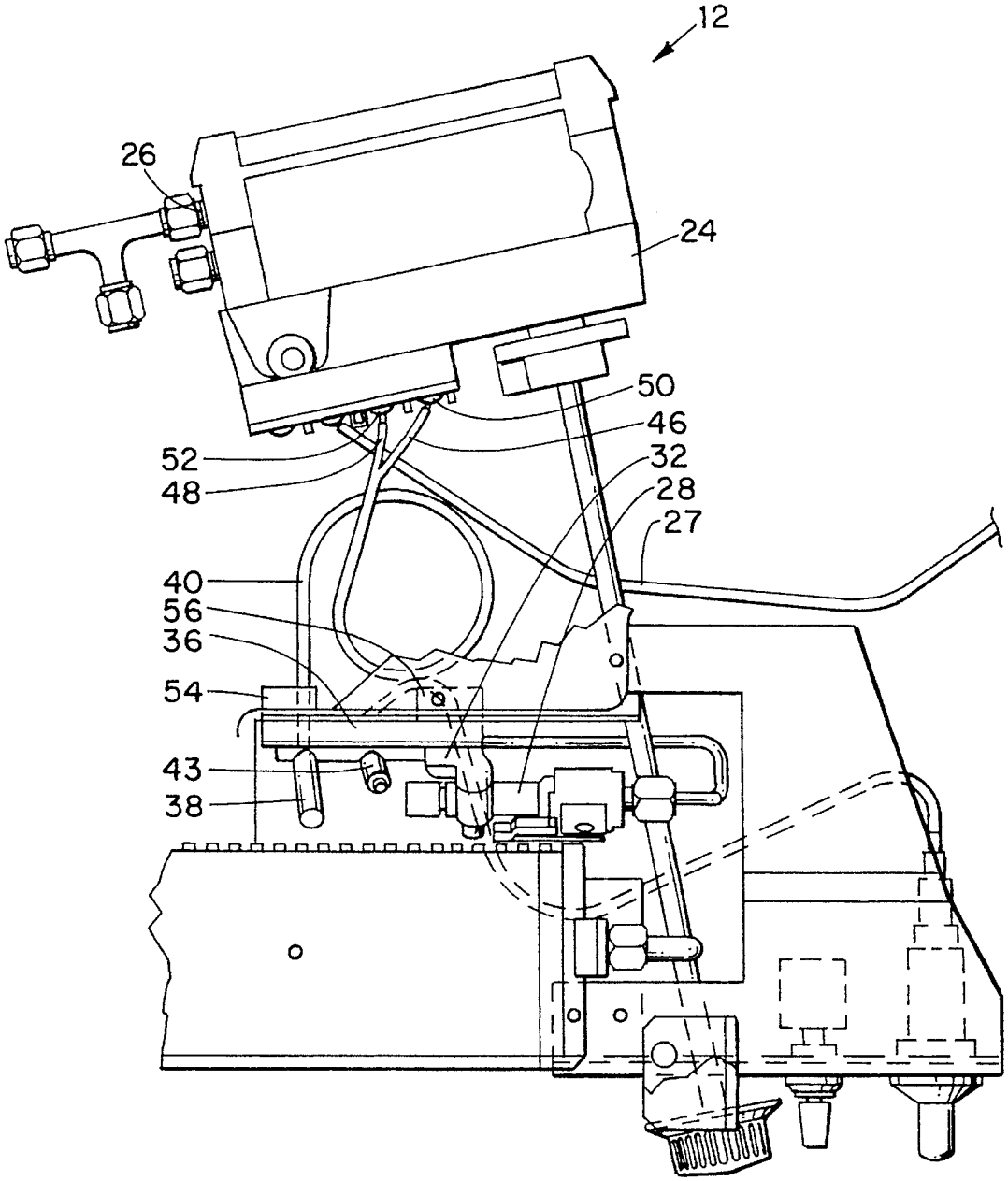
FIG. 2 is a more detailed top view of the apparatus of the subject invention.
Figure 3A:
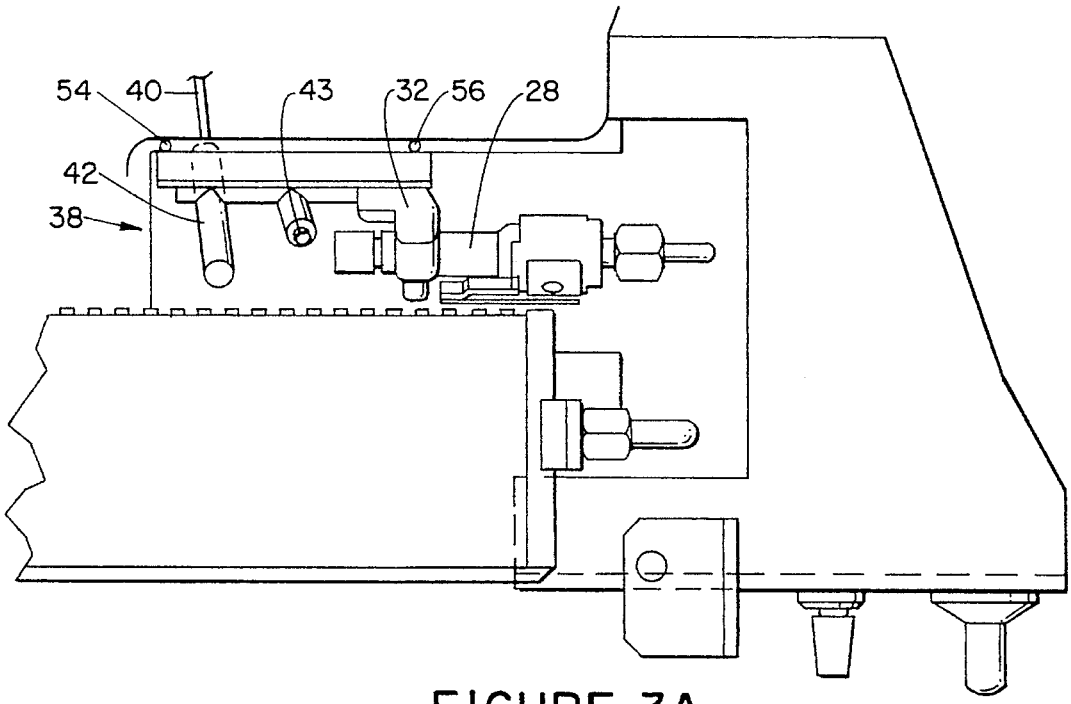
FIG. 3A is a top view of the apparatus shown in FIG. 3.
Figure 3:
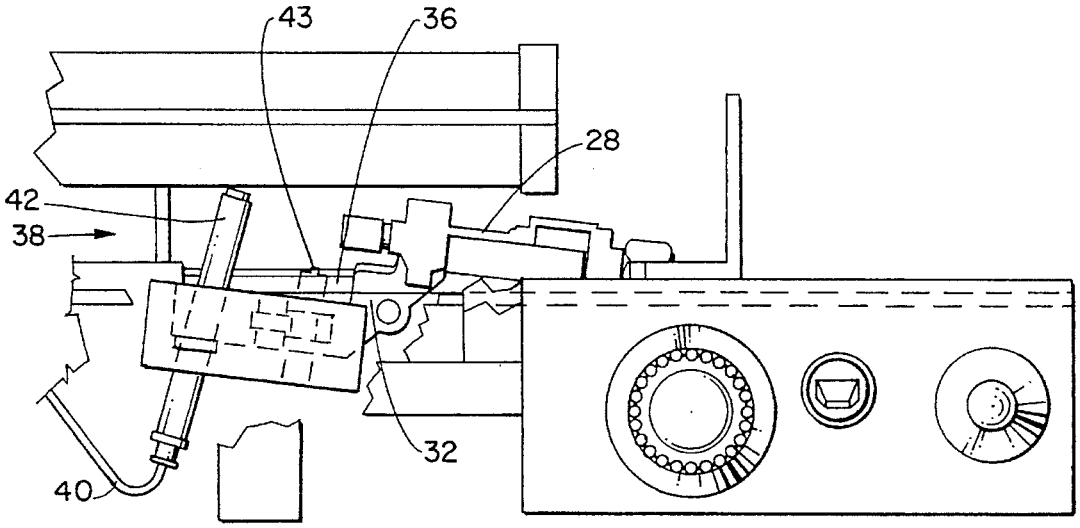
FIG. 3 is a side elevational view showing a portion of the apparatus shown in FIG. 2.
Figure 4:
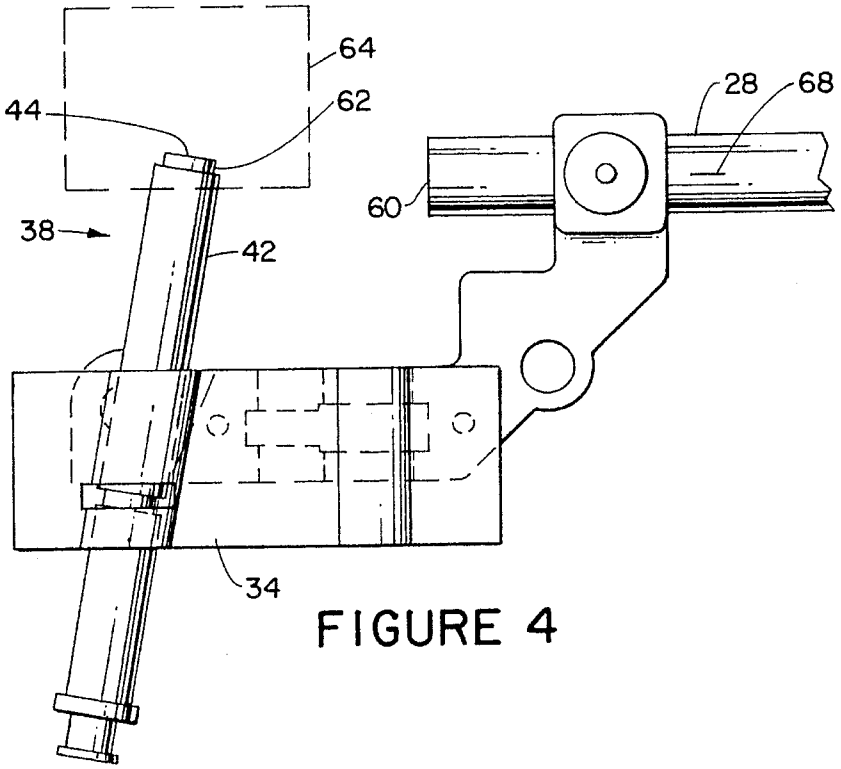
FIG. 4 is a side elevational view of a portion of the apparatus of FIG. 2.
Figure 6:
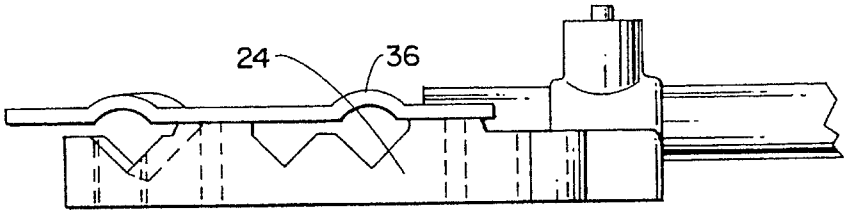
FIG. 6 is a partial top view of the apparatus of FIG. 4 showing the brackets.

Referring now more particularly to FIGS. 1 through 6, there is provided gas fired artificial log assembly 10, including a gas control apparatus 12 and gas log assembly 14. Log assembly 14 includes logs 16 and 18 and log support 20. Only two logs are shown for simplicity, however, normally more logs would normally be used. Gas burner 22 is located under logs 16 and 18. Gas control system 12 includes gas valve 24 which is fully automatic and is preferably made by ITT General Controls Division (Catalog No. B67RA01). The ITT valve requires at least 140 millivolts under load to be operated. The main burner 22 is connected to the gas valve 24 through opening 26. It is preferred that thermostat 25 be connected to gas valve 24 through wires 27 so that the gas will be automatically turned on and off when the temperature of the room reaches predetermined levels.

Pilot 28 is also connected to gas valve 24 through opening 30. Pilot 28 includes a oxygen depletion sensor inside of the pilot housing. The oxygen depletion sensor is not shown. Pilots having an internal oxygen depletion sensor are commercially available from the Sourdillon Company as Part Nos. 50021/855N and 50020/855P. Pilot 28 includes mounting extension 32. Brackets 34 and 36 contact mounting extension 32. A thermal responsive generator 38 is mounted to brackets 32 and 34. The thermal responsive generator is electrically connected to valve 24 through cable 40. The thermal responsive generator 38 includes an outer barrel 42 having top 44. A thermopile (not shown) is received inside the outer barrel near top 44. The thermopile leads 46 and 48 are electrically connected to terminals 50 and 52 of valve 24. The thermopile is designed to generate at least 140 millivolts under load and between 250 and 750 millivolts when not under load so as to enable it to operate the ITT valve 24 or other fully automated type valve requiring a high voltage. Acceptable thermal responsive generators are commercially available from ITT, as Part Nos. B67RA224N and B67SA225P. Generator barrel 42 and ignitor 43 are held between brackets 34 and 36. Bracket 36 is connected to the main gas burner 22 through mounting tabs 54 and 56.

Pilot 28 includes opening 60 from which the pilot flame emanates. Point 62 on the barrel 42 of the thermal responsive electrical generator 38 represents the nearest point of the generator barrel to opening 60 in the pilot. The phantom box 64 represents the permissible range in which the point 62 may be positioned from opening 60 so that the generator will continue to operate, i.e., supply sufficient voltage while the pilot flame is on but will not permit the gas coming from the pilot to continue to burn about the generator when the oxygen depletion sensor senses low oxygen and causes the pilot flame to extinguish but not the flow of gas from the pilot. It has been found that by using a large generator, i.e., with a thermopile having an output under load of at least 140 millivolts and between 240 and 750 millivolts when not under load and with a barrel outer diameter of at least 25 inch, substantial heat is retained on the generator barrel while the pilot flame is on. If the barrel is too close to the pilot opening, the hot barrel will cause a flame to continue to form around the barrel after the oxygen depletion sensor extinguishes the pilot flame, thereby causing the pilot generator to continue to operate, i.e., supply voltage to valve 24. Thus the low oxygen safety feature of the system would fail because the main gas, as well as the pilot gas, would not be turned off in a low oxygen situation. It is believed that a generator barrel having an outer diameter of at least 0.20 inch located near the pilot opening would retain sufficient heat to cause the operational problems set forth above.

A 250 to 750 millivolts (at least 140 millivolts under load) generator normally includes an assembly of many thermocouples forming a thermopile which take a larger barrel and provide the higher voltage.

Figure 5:
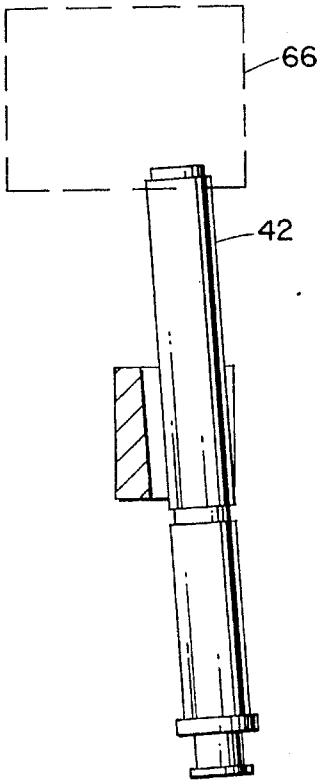
FIG. 5 is a partial front elevational view of the apparatus of FIG. 4 showing the thermal responsive generator.

Phantom box 66 shown in FIG. 5 also shows the range which point 62 on barrel 42 may be moved in a plane which is normal to the longitudinal axis 68 of the pilot 28. This range is between 0.5 and 1.5 horizontal inches and between 0.75 and 1.5 vertical inches from the point where axis 68 penetrates box 66.

The range shown in box 64 is between 0.50 and 1.5 inches away from opening 60 and up to 1.5 inches above opening 60.

The ranges set forth above enable the user to use both natural gas and propane. Natural gas is more volatile than propane, i.e., producing more BTUs than propane. Propane systems are operated at a higher pressure, i.e., 8 to 11 water columns, while natural gas systems are operated at a lower pressure of normally 3 water columns. For propane use it is preferred that generator 38 be mounted approximately 10° from vertical with the axis 68 being horizontal. For natural gas it is preferred that generator 38 be mounted at a right angle to axis 68.

In addition, it is preferred that the longitudinal axis 68 and thus the pilot 28 be mounted at least 4° above horizontal with opening 60 being the elevated position.

Thus, applicant has provided a gas log control system which includes a oxygen depletion sensor and may be safely and effectively used with a fully automated gas valve.

From the foregoing description of the preferred embodiment of the invention, it will be apparent that many modifications may be made therein. It is to be understood that all such modifications are embodied in the accompanying claims which come within the true spirit and scope of this invention.

What is claimed is:

1. As assembly for controlling the flow of gas for gas fired artificial logs comprising:

a main burner and a pilot; a gas valve for controlling the flow of gas to said main burner and to said pilot; said pilot having an opening where flame is produced; said pilot connected to said gas valve; said pilot including a oxygen depletion sensor for extinguishing the pilot flame but not the flow of gas when the surrounding oxygen reaches a predetermined low level; a thermal responsive electrical generator; said generator generating at least 140 millivolts when under load; said generator connected to said gas valve; said generator including an outer barrel; said outer barrel being spaced apart from said pilot opening; the distance between said pilot opening and the point on said barrel nearest said pilot opening is such that said generator will generate sufficient voltage to operate said valve when flame is emanating from said pilot opening and is such that the gas coming from said pilot opening after the flame has been extinguish will not cause ignition about said barrel.

2. An assembly as set forth in claim 1, wherein the distance from said point on said barrel nearest said pilot opening being from 0.5 inches to 1.5 inches from said opening.

3. An assembly as set forth in claim 1, wherein said barrel has a top; said top of said barrel located above said pilot opening.

4. An assembly as set forth in claim 2, wherein said nearest point of said barrel to said pilot opening being in a plane which is normal to the longitudinal axis of said pilot and being located no more than 0.5 inches from the intersection of said axis to said plane.

5. An assembly as set forth in claim 1, wherein said generator generates between 250 millivolts and 750 millivolts when not under load.

6. An assembly as set forth in claim 1, wherein said gas is taken from the group consisting of natural gas and propane.

7. An assembly as set forth in claim 4, wherein said point on said barrel nearest to said pilot opening is at least 0.5 inches vertically from the intersection of said plane and said axis.

8. An assembly as set forth in claim 1, wherein said generator includes a thermopile.

9. An assembly as set forth in claim 1, wherein said valve closes in response to said generator generating insufficient voltage.

10. An assembly as set forth in claim 1, further including a thermostat connected to said valve for controlling said main burner, whereby said valve is fully automatic.

11. An assembly as set forth in claim 1, further including an ignitor located between said pilot opening and said generator.

12. An assembly as set forth in claim 2, further including a bracket member, said generator and said pilot mounted to said bracket member.

13. An assembly as set forth in claim 12, wherein said bracket member includes two plates; a first plate contacting said generator and said pilot and second plate mounted to said main burner.

14. An assembly as set forth in claim 1, wherein said generator is mounted at an angle between 0° and 10° from vertical, with the longitudinal axis of said pilot being horizontal.

15. An assembly for controlling the flow of gas for gas fired artificial logs, comprising:

a main burner and a pilot; a gas valve for controlling the flow of gas to said main burner and to said pilot; said pilot having an opening where flame is produced; said pilot connected to said gas valve; said pilot including a oxygen depletion sensor for extinguishing the pilot flame but not the flow of gas when the surrounding oxygen reaches a predetermined level; a thermal responsive generator; said thermal responsive generator connected to said gas valve; said thermal responsive generator including an outer barrel; said outer barrel being spaced apart from said pilot opening; the point of said barrel nearest said pilot opening being at a distance such that said thermal responsive electrical generator will generate sufficient voltage to maintain said valve open when flame is emanating from said pilot opening and such that the gas coming from said pilot opening after the flame has been extinguished due to low oxygen will not permit ignition about said barrel.

16. An assembly as set forth in claim 15, wherein said outer barrel of said thermal responsive generator is at least 0.20 inch in diameter.

17. An assembly for controlling the flow of gas to gas fired artificial logs comprising:

a main burner and a pilot; a gas valve for controlling the flow of gas to said main burner and to said pilot; said pilot having an opening where flame is produced; said pilot connected to said gas valve, said pilot including a oxygen depletion sensor for extinguishing the pilot flame but not the flow of gas when the surrounding oxygen reaches a predetermined low level; a thermal responsive electrical generator generating at least 140 millivolts under load; said electrical generator connected to said gas valve; said generator including an outer barrel; said outer barrel being spaced apart from said pilot opening; at least a portion of said barrel being located above said pilot opening; the point on said barrel nearest said opening being at a distance from said opening such that said thermal responsive electrical generator will generate sufficient voltage to operate said valve when said flame is emanating from said opening, and is such that the gas coming from said pilot opening after the flame has been extinguished due to low oxygen will not permit ignition about said barrel.

18. An assembly as set forth in claim 17, wherein said outer barrel of said thermal responsive generator being at least 0.20 inch in diameter.

19. An assembly as set forth in claim 17, wherein said distance is between 0.5 and 1.5 inches.

* * * * *